US008642903B2

(12) United States Patent
Sadowski et al.

(10) Patent No.: US 8,642,903 B2
(45) Date of Patent: Feb. 4, 2014

(54) SWITCH WITH PIVOTING ACTUATOR

(75) Inventors: Walter Sadowski, Newington, CT (US); Joseph LeClair, III, Plymouth, CT (US)

(73) Assignee: Carling Technologies, Inc., Plainville, CT (US)

( * ) Notice: Subject to any disclaimer, the term of this patent is extended or adjusted under 35 U.S.C. 154(b) by 140 days.

(21) Appl. No.: 13/296,013

(22) Filed: Nov. 14, 2011

(65) Prior Publication Data

US 2012/0118713 A1 May 17, 2012

Related U.S. Application Data

(60) Provisional application No. 61/413,124, filed on Nov. 12, 2010.

(51) Int. Cl.
*H01H 19/00* (2006.01)
*H01H 21/00* (2006.01)

(52) U.S. Cl.
USPC ..... 200/11 J

(58) Field of Classification Search
USPC ..... 200/11 J, 6 R, 11 R, 16 R, 16 C, 17 R, 200/19.03, 19.07, 19.18, 19.2, 447–450, 200/455, 456, 461, 463, 464, 465, 532, 540, 200/553, 329, 339, 345
See application file for complete search history.

(56) References Cited

U.S. PATENT DOCUMENTS

| | | | | |
|---|---|---|---|---|
| 4,358,649 | A | 11/1982 | Petz | |
| 4,748,297 | A | 5/1988 | Sorenson et al. | |
| 5,045,648 | A * | 9/1991 | Fogleman, Sr. | 200/43.16 |
| 5,186,316 | A | 2/1993 | Mortun et al. | |
| 5,725,087 | A | 3/1998 | Ives | |
| 6,069,545 | A | 5/2000 | Van Zeeland | |
| 6,600,122 | B1 * | 7/2003 | Czarnecki et al. | 200/553 |
| 6,930,269 | B1 * | 8/2005 | Lee et al. | 200/553 |
| 2003/0230475 | A1 | 12/2003 | Koide et al. | |

OTHER PUBLICATIONS

International Search Report & Written Opinion of the International Searching Authority; Application No. PCT/US2011/060563; Issued: Feb. 23, 2012; Mailing Date: Mar. 8, 2012; 7 pages.

* cited by examiner

*Primary Examiner* — Edwin A. Leon
*Assistant Examiner* — Anthony R. Jimenez
(74) *Attorney, Agent, or Firm* — St. Onge Steward Johnston & Reens LLC

(57) ABSTRACT

A rotary switch having a body, a rotary knob attached to the body, and at least two terminals attached to the body. An actuator is pivotably mounted within the body and operably connected to the rotary knob, the actuator pivoting upon a rotation of the rotary knob. A conductor is pivotably mounted in the body and is in communication with the actuator. The conductor is adapted to connect or disconnect the at least two terminals when the actuator is pivotably moved.

31 Claims, 7 Drawing Sheets

SWITCH WITH PIVOTING ACTUATOR

CROSS-REFERENCE TO RELATED APPLICATIONS

The present application claims the benefit under 35 U.S.C. §119(e) of U.S. Provisional Patent Application Ser. No. 61/413,124 filed on Nov. 12, 2010.

FIELD OF THE INVENTION

The present invention relates generally to the field of electrical switches, and more specifically, relates to a switch employing a pivotal movement to connect and disconnect multiple terminals.

BACKGROUND OF THE INVENTION

There are currently a wide variety of electrical switches available on the market. Some are actuated by rotation of a rotary such as a knob while others require depressing one side or another of a rocker. The internal movements of electrical contacts and components that translate the movement of the switch actuator to the movement of the contacts are typically dependent upon the particular actuation mechanism employed. Although such switches adequately serve the purpose for which they were designed, switches that employ different internal mechanisms may be beneficial to manufacturers thereof. Additionally, the industry is always receptive to new designs.

SUMMARY OF THE INVENTION

The invention is directed toward a switch for electrically connecting and disconnecting electrical terminals. The switch uses a pivoting action of an actuator, which actuates a conductor to connect and disconnect the electrical terminals.

These and other embodiments of the present invention are achieved by provision of a rotary switch having a body, a rotary knob attached to the body, and at least two terminals attached to the body. An actuator is pivotably mounted within the body and operably connected to the rotary knob, the actuator pivoting upon a rotation of the rotary knob. A conductor is pivotably mounted in the body and is in communication with the actuator and is adapted to connect or disconnect the at least two terminals when the actuator is pivotably moved.

In some embodiments, a plunger is movably mounted to the actuator and a biasing member is in operable communication with the actuator and the plunger, the biasing member biasing the plunger away from the actuator. In some embodiments, a cam is located between the rotary knob the said actuator and is eccentric to a rotational axis of the rotary knob, the cam translating a rotational movement of the rotary knob into a pivotable movement of the actuator. In some embodiments, a roller is attached to the plunger, the roller rolling along the conductor to connect or disconnect the at least two terminals when the actuator is pivoted. In some embodiments, the conductor is in slideable communication with the actuator. In some embodiments, the biasing member is a spring. In some embodiments, at least one detent in the conductor is adapted to fit the roller.

In some embodiments, a plurality of detents in the body are located adjacent to the rotary knob and are adapted to fit a nose of the rotary knob. In some embodiments, a biasing member in the biases the nose in an extended position inside one of the plurality of detents. In some embodiments, the rotary pivots about a first axis, the actuator pivots about a second axis, the second axis being different than the first axis, and the conductor pivots about a third axis, the third axis being different than the first axis and the second axis. In some embodiments, the second axis and the third axis are parallel. In some embodiments, the first axis is orthogonal to the second axis and the third axis.

In another embodiment of the present invention is a switch having a body and at least two terminals attached to the body. An actuator is pivotably mounted within the body. A conductor is pivotably mounted in the body and is in communication with the actuator and is adapted to connect or disconnect the at least two terminals when the actuator is pivotably moved.

In some embodiments, a plunger is movably mounted to the actuator and a biasing member is in operable communication with the actuator and the plunger and biases the plunger away from said actuator. In some embodiments, a roller is attached to the plunger and rolls along the conductor to connect or disconnect the at least two terminals when the actuator is pivoted. In some embodiments, the conductor is in slideable communication with the actuator. In some embodiments, the switch is a rotary switch having a rotary knob attached to the body and a cam located between the rotary knob and the actuator and eccentric to a rotational axis of the rotary knob, the cam translating a rotational movement of the rotary knob into a pivotable movement of the actuator.

In some embodiments, the switch is a rocker switch, having a rocker attached to the body and the actuator, the rocker pivoting the actuator on actuation of the rocker. In some embodiments, the biasing member is a spring. In some embodiments, at least one detent in the conductor is adapted to fit the roller. In some embodiments, a plurality of detents in the body are located adjacent to the rotary knob and are adapted to fit a nose of the rotary knob. In some embodiments, a biasing member is in the nose and biases the nose in an extended position inside one of the plurality of detents. In some embodiments, the rotary pivots about a first axis, the actuator pivots about a second axis, the second axis being different than the first axis and the conductor pivots about a third axis, the third axis being different than the first axis and the second axis. In some embodiments, the second axis and the third axis are parallel. In some embodiments, the first axis is orthogonal to the second axis and the third axis.

In another embodiment of the present invention is a rotary switch having a body, a rotary knob attached to the body, and at least two terminals attached to the body. An actuator is pivotably mounted within the body and is operably connected to the rotary knob through a cam, the cam translating a rotational movement of the rotary knob into a pivotable movement of the actuator and being eccentric to a rotational axis of the rotary knob. A plunger is movably mounted to the actuator. A spring is in operable communication with the actuator and the plunger and biases the plunger away from the actuator. A conductor is pivotably mounted within the body and is in rolling communication with the actuator through a roller. The conductor has least one detent and is adapted to connect or disconnect the at least two terminals when the actuator is pivotably moved. The roller is attached to the plunger and the roller rolls along the conductor to connect or disconnect the at least two terminals when the actuator is pivoted.

In some embodiments, a plurality of detents in the body are located adjacent to the rotary knob and are adapted to fit a nose of the rotary knob. In some embodiments, a biasing member in said nose biases the nose in an extended position inside one of the plurality of detents. In some embodiments, the rotary knob pivots about a first axis, the actuator pivots about a second axis, the second axis being different than the first axis, and the conductor pivots about a third axis, the third axis being different than the first axis and the second axis. In some embodiments, the second axis and the third axis are parallel. In some embodiments, the first axis is orthogonal to the second axis and the third axis.

DETAILED DESCRIPTION OF THE INVENTION

Figure 1:
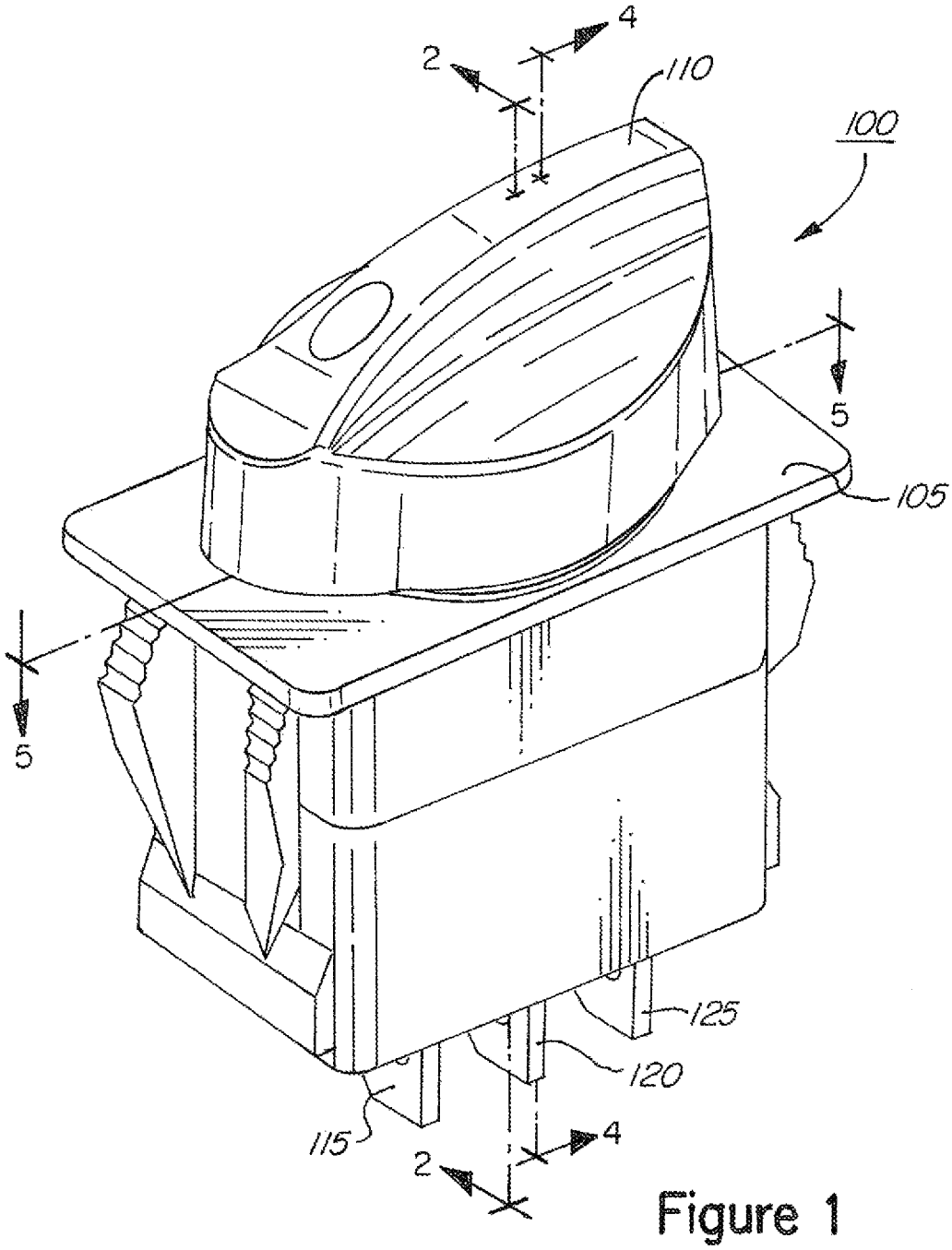
FIG. 1 is a perspective view of a rotary switch according to the present invention.

The exemplary embodiments of the present invention may be further understood with reference to the following description and the related appended drawings, wherein like elements are provided with the same reference numerals. One exemplary embodiment of the present invention is related to a rotary switch. Specifically, the rotational movement of the rotary switch is translated into a pivoting movement of an actuator in order to connect and disconnect multiple terminals. Another exemplary embodiment employs a rocker switch to pivot the actuator in order to connect and disconnect multiple terminals. Those skilled in the art will understand that the present invention may be implemented on many other electrical switches.

As best seen in FIG. 1, a perspective view of a rotary switch 100 is shown. The rotary switch 100 includes a body 105 and a rotary, shown as a knob 110, rotationally mounted to the body 105. Rotary switch 100 has a plurality of terminals such as terminals 115, 120, and 125. It should be noted that while rotary switch 100 is shown having six terminals, rotary switch 100 can be modified to operate with greater than or less than six terminals.

Figure 2:
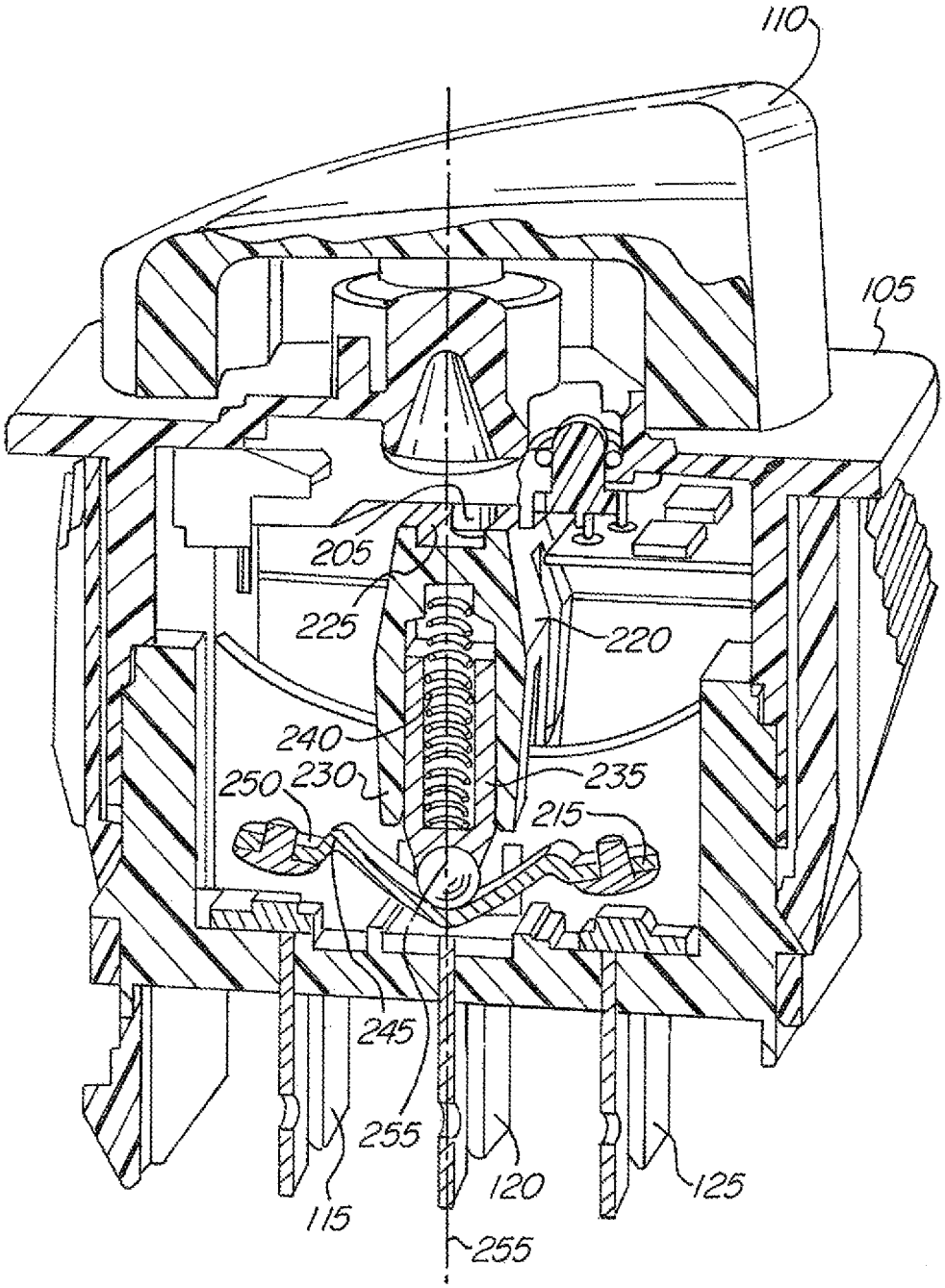
FIG. 2 is a cut-away of a perspective view of the rotary switch according to FIG. 1 taken along line 2-2 of FIG. 1.
Figure 3:
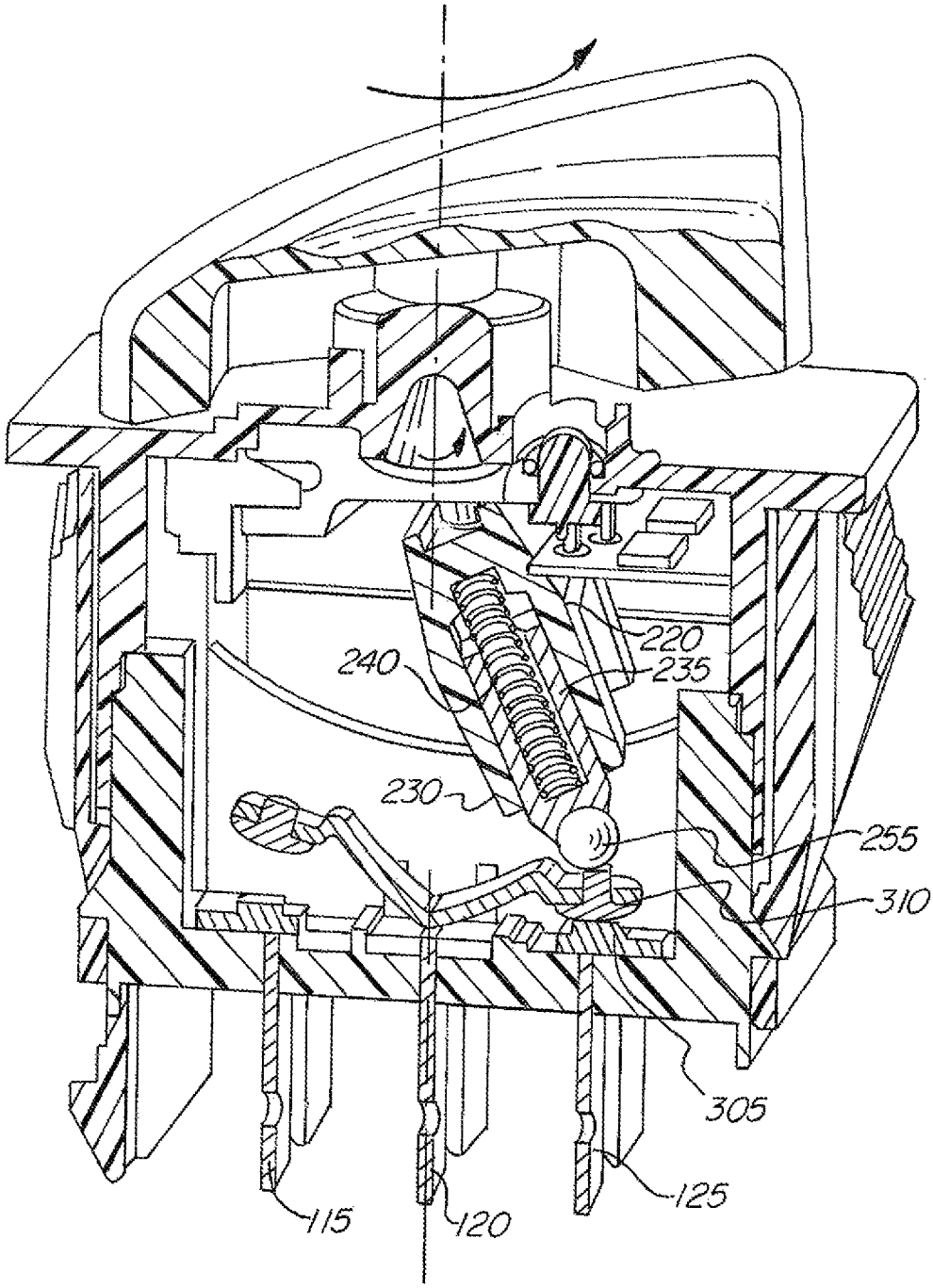
FIG. 3 is a cut-away of a perspective view of the rotary switch according to FIG. 1 taken along line 2-2 of FIG. 1.
Figure 4:
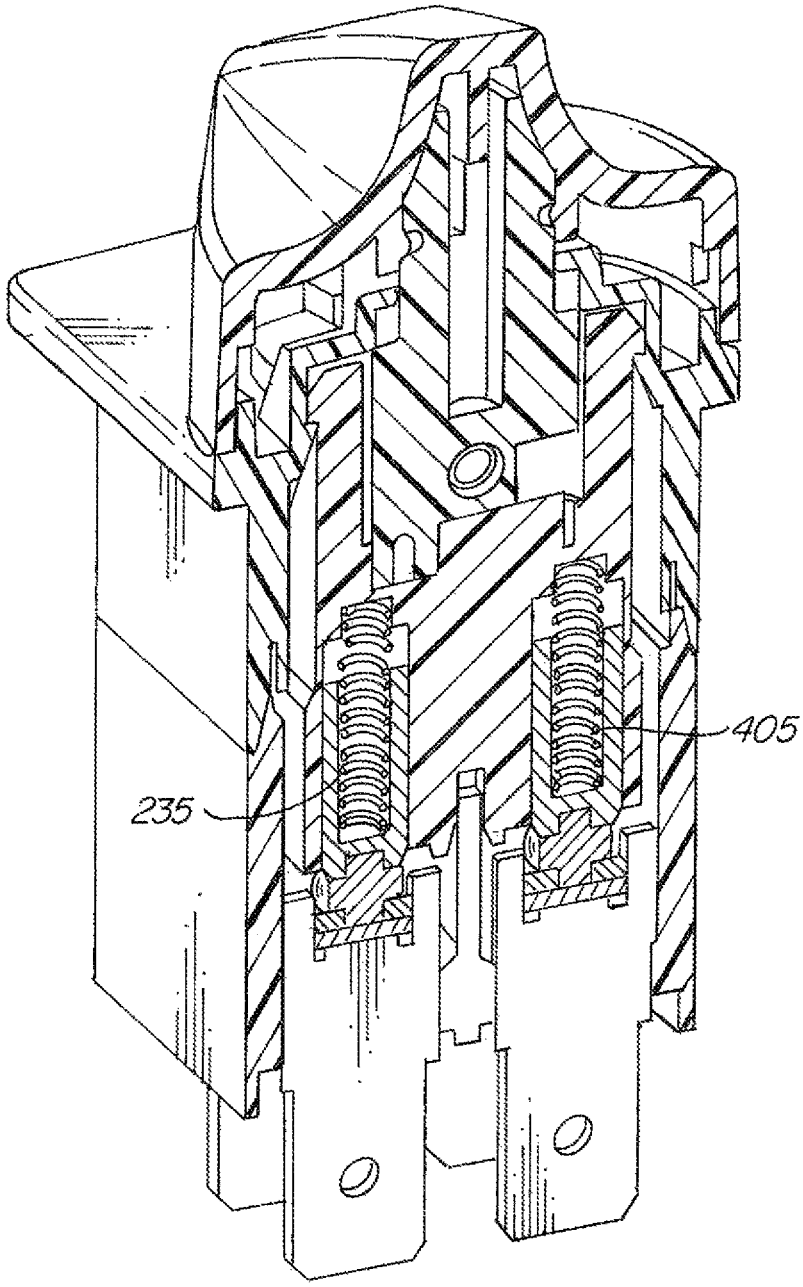
FIG. 4 is a cut-away of a perspective view of the rotary switch according to FIG. 1 taken along line 4-4 of FIG. 1.

As best seen in FIGS. 2 and 3, cut-away perspective views of rotary switch 100 along line 2-2 are shown. Knob 110 has a portion 205, as a post, a cam, or the like that is eccentric to a rotational axis 210 of the rotary switch 100. Terminals 115, 120, and 125 are mounted to the body 105 and a conductor 215 is configured to be movable from at least one position wherein the conductor 215 is electrically connected to both terminals 115 and 120, a second position wherein the conductor 215 is electrically connected to both terminals 120 and 125, and a third position wherein the conductor 215 is electrically disconnected from terminals 115 and 125. The rotary switch 100 further has an actuator 220 that is pivotally mounted within the body 105 at one end 225 as seen in FIG. 4, and is movably engaged with the conductor 215 at the other end 230. Rotational movement of the rotary 105 causes the eccentric portion 205 to rotate about the axis 210. Engagement of the eccentric portion 205 with the actuator 220 causes the actuator 220 to pivot.

Rotary switch 100 has a plunger 235 that is movably mounted within a recess in actuator 220 along with a biasing member 240, shown as a compression spring, biasing the plunger 235 in a direction away from the actuator 220. The spring 240 assures that the plunger 235 remains in contact with the conductor 215 throughout the pivotal travel of the actuator 220. It should be noted that plunger 235 and spring 240 need not be present and the flexing of the conductor 215 may be used to assure continuous contact between the actuator 220 and the conductor 215. Rotary switch 100 may also include a roller 255 that is rotationally mounted to the plunger 235. The roller 255 rolls relative to the conductor 215 to reduce frictional engagement between the plunger 235 and the conductor 215.

As seen in FIG. 3, conductor 215 moves relative to the body 105 in a rocking or seesaw type motion in response to the actuator 220 pivotally moving relative to the body 105. As such, the terminals 115, 120, and 125 are electrically connected to one another through the conductor 215 when the actuator 220 is pivoted. For example, in FIG. 3, conductor 120 is electrically connected to conductor 125 when actuator 220 is pivoted to the right. When actuator 220 is not pivoted, neither terminal 115 nor terminal 125 is electrically connected to terminal 120. Although not illustrated in the Figures, additional terminals could be electrically connected and disconnected via the pivotal movement of the actuator 220 through the movement of the conductor 215, or through movement of an additional conductor added to the assembly and moved by the actuator 220 in a similar manner to the movement of the conductor 215. For example, see FIG. 4 wherein a second plunger 305 can be actuated to connect additional terminals.

The shape of the surface 245 of the conductor 215 and the rocking movement of the conductor 215 may be configured such that the plunger 235 is at a further distance from the actuator 220 when the actuator 220 is pivoted to the selected positions within its travel. In so doing, the spring 240 will generate a bias on the conductor 215. Conductor 215 is capable of being flexed in a downward direction forcing end 310 of conductor 215 to contact the top portion 305 of terminal 125. This creates an electrical connection between terminals 120 and 125. Rotary switch 100 is capable of being rotated into multiple positions some of which are configured to make electrical contact between the terminals 115, 120, and 125, and some of which are configured to maintain the rotary switch 105 in a position where there is no electrical contact between any of the terminals. This pivotal biasing of the actuator 220 will also generate a bias on the knob 110. This bias on the knob 110 will preferentially maintain the knob 110 at specific positions within its rotational travel. Additionally, conductor 215 may have detents 250, on either side of the conductor, shaped to allow roller 255 to fit inside, preventing knob 110 from rotating back into a position of no electrical contact between the conductors.

Figure 5:
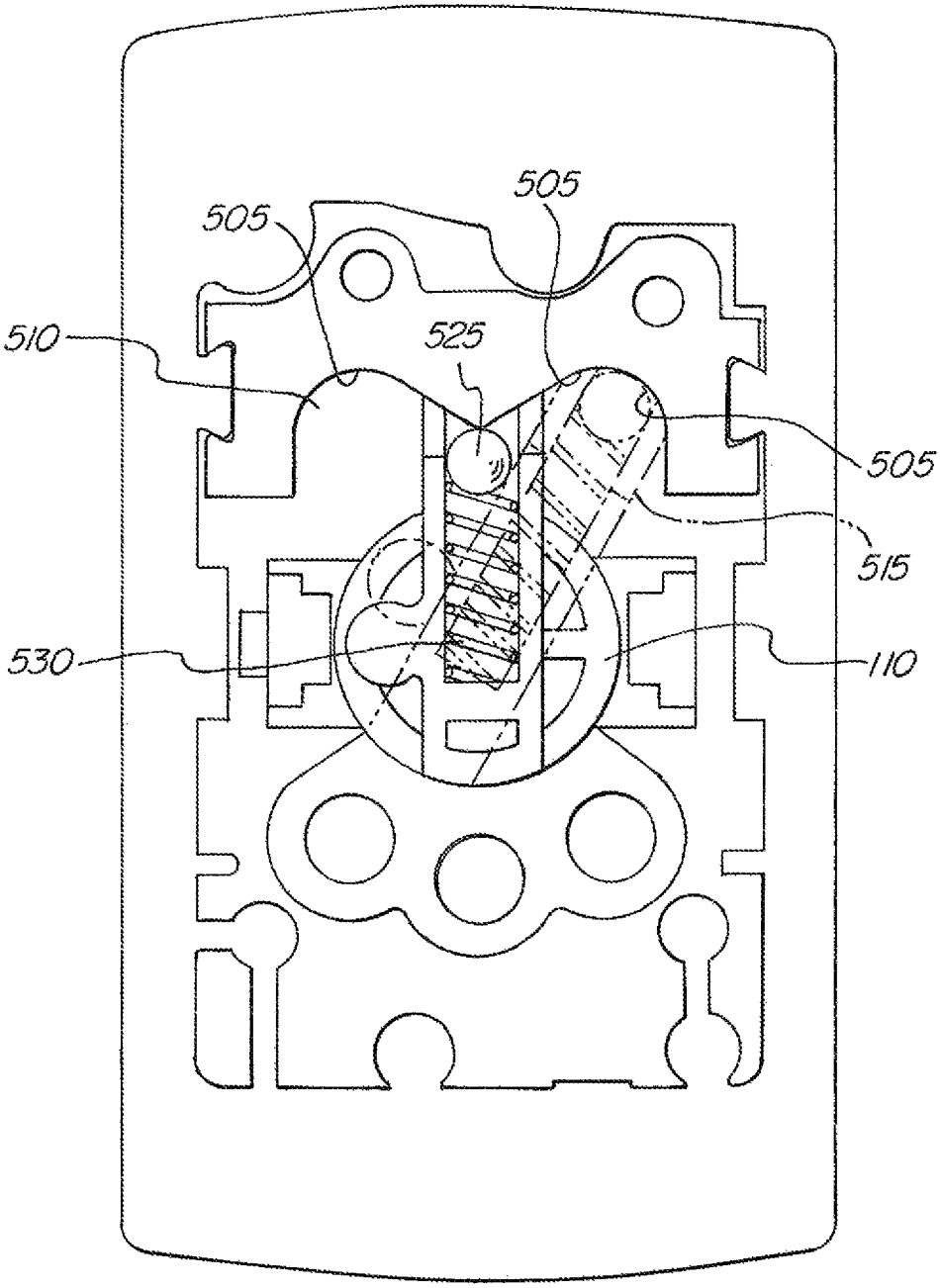
FIG. 5 is a top-down cut-away view of the rotary switch from FIG. 1 taken along line 5-5 of FIG. 1.

As best seen in FIG. 5, is a top-down cut-away view of the rotary switch 100 from FIG. 1 taken along line 5-5 of FIG. 1 is shown. Rotary switch 100 may have detents 505 having a cam surface 410 thereof that is substantially fixed relative to the body 105. A nose 520 of a follower 515 is made to move or flex as the follower 515 is rotated. The nose 520 is a separate steel ball 525 and is able to rotate as it moves along the cam surface 510. A biasing member 530, shown as a compression spring, biases the nose 520 toward the cam surface 510 to thereby assure continuous contact therewith and provide the rotational detent positioning effect desired by the detents 510. As knob 110 is rotated, a corresponding pivoting movement is created in actuator 220. For example, a rotation of knob 110 by 18 degrees may correspond to a pivot of 60 degrees of actuator 220.

Detents 505 prevent knob 110 from being in a non-rotated state, or partially open state, such as that shown in FIG. 5. Detents 505 will always move knob 110 to the desired state. Detents 505 also assist in providing a smooth and crisp tactile feel to the rotation of knob 110 such that the person who actuates the switch is given direct feedback as to whether knob 110 has been rotated and the terminals have been electrically connected or disconnected. It should be noted that while rotary switch 100 is shown as having two detents for two rotational positions, rotary switch 100 may have any number of detents corresponding to any number of rotational positions including more than two detents.

Figure 6:
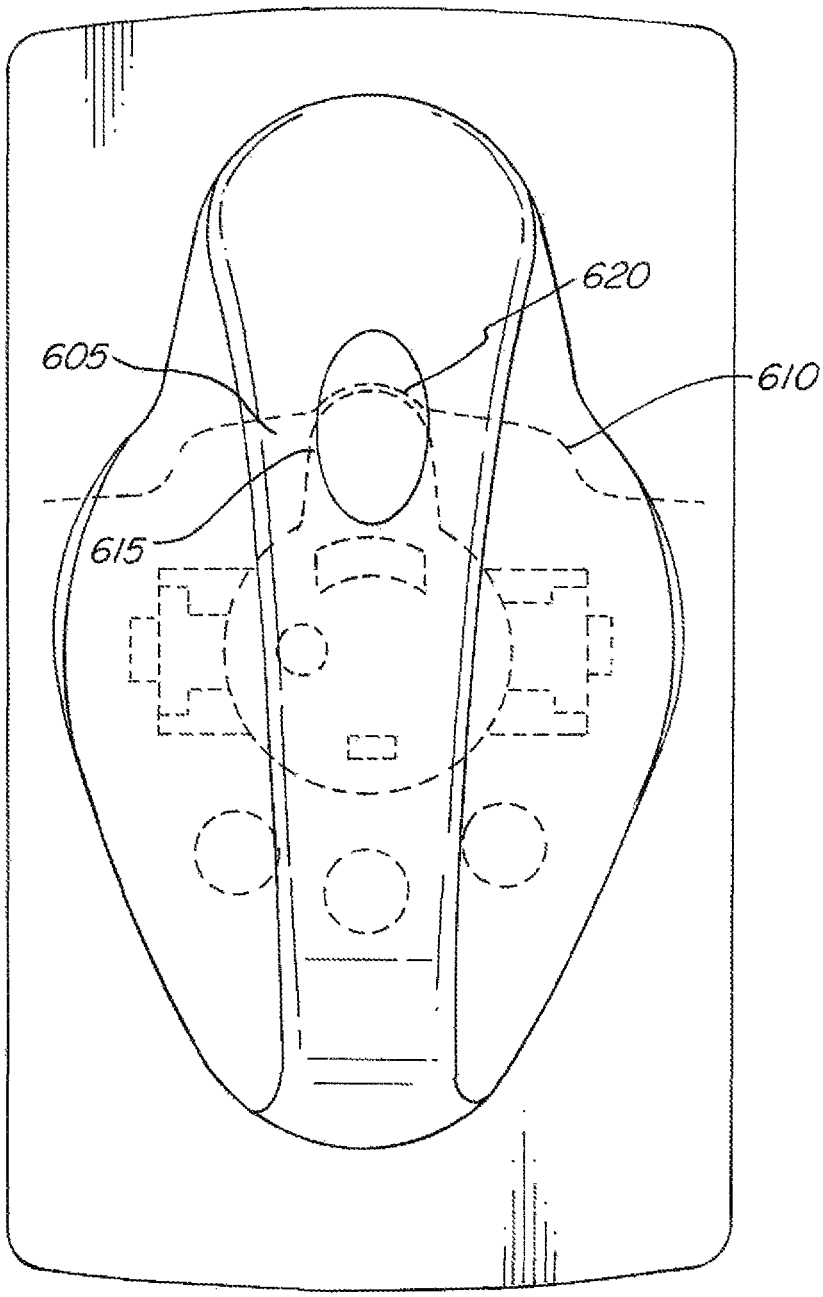
FIG. 6 is a top-down cut-away view of an alternate configuration of the rotary switch from FIG. 1 taken along line 5-5 of FIG. 1.

As best seen in FIG. 6, a top-down cut-away view of an alternate configuration of the rotary switch of FIG. 1 is shown. Rotary switch 600 may have a plurality of detents 605. The plurality of detents 605 provide additional biasing of the rotary 610 to selected rotational positions. Detents 605 may include a cam surface 610 disposed on the body 105, and a follower 615 configured to follow the cam surface 610. The cam surface 610 may be flexible relative to the body 105 to allow a nose 620 on the follower 615 that moves along a circular arc, to deflect the cam surface 610 as the follower rotates relative thereto. The flexibility of the cam surface 610 provides a load between the nose 620 and the cam surface 610 needed to provide the rotational detent positioning effect desired by the detents 605; nose 620 being slideably engaged with the cam surface 610. It should be noted that while rotary switch 600 is shown as having three detents for three rotational positions, rotary switch 600 may have any number of detents corresponding to any number of rotational positions including more than three detents.

Figure 7:
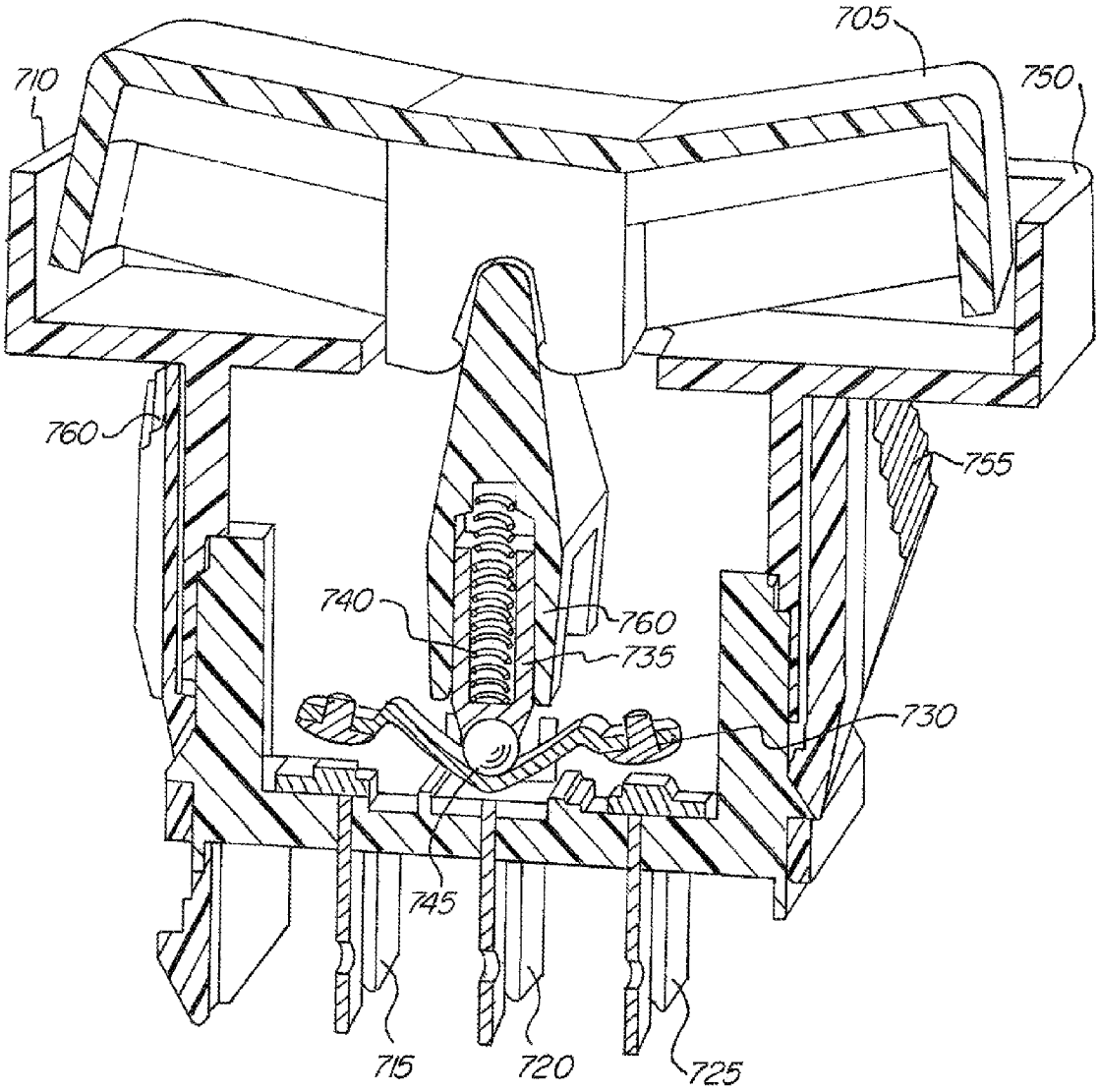
FIG. 7 is a cross-section of a perspective view of a rocker switch incorporating many of the features of the rotary switch of FIG. 1.

As best seen in FIG. 7, a cross-section of a perspective view of a rocker switch 700 incorporating many of the features of the rotary switch of FIG. 1 is shown. Rocker switch 700 has a rocker 705 attached to a housing 710 that electrically connects the terminals 715, 720, and 725. A conductor 730, a plunger 735, a biasing member 740 and a roller 745 of the rocker 700 operate in a manner similar to the components of rotary switch 100 above. Mounting features such as a flange 750, and ratchet teeth 755 on flex tabs 760, can all be identically dimensioned between the rocker switch 700 and the rotary switch 100 above, thereby allowing either switch to be mounted in a particular application. This flexibility would allow a customer to customize applications without having to alter the mounting configurations, or the harness that controls the electrical loads. This commonality of components also provides monetary savings to switch manufacturers through reduced component tooling and assembly equipment.

When rocker 705 is depressed, either on the left side or the right side of the rocker, actuator 760 is pivoted, causing plunger 735 and roller 745 to move in either the left or right direction. The movement of plunger 735 and roller 745, in conjunction with biasing member 740, results in an electrical contact either between terminals 715 and 720, or between terminals 725 and 720. To cease electrical contact, the user depresses the side of the rocker opposite to the side depressed to electrically connect the terminals.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Furthermore, the use of the terms a, an, etc. do not denote a limitation of quantity, but rather denote the presence of at least one of the referenced item.

What is claimed is:

1. A rotary switch comprising:

a body;

a rotary knob attached to said body;

at least two terminals attached to said body;

an actuator pivotably mounted within said body and operably connected to said rotary knob, said actuator pivoting upon a rotation of said rotary knob;

a conductor pivotably mounted in said body and in communication with said actuator, said conductor adapted to connect or disconnect said at least two terminals when said actuator is pivotably moved;

wherein said body comprises a cam surface having at least one detent portion; and, wherein said knob comprises a projection which follows the cam surface and which is rotatable with the knob to follow the cam surface into and out of engagement with the at least one detent.

2. The rotary switch according to claim 1, further comprising a plunger movably mounted to said actuator and a biasing member in operable communication with said actuator and said plunger, said biasing member biasing said plunger away from said actuator.

3. The rotary switch according to claim 1, further comprising a cam located between said rotary knob and said actuator and eccentric to a rotational axis of said rotary knob, said cam translating a rotational movement of said rotary knob into a pivotable movement of said actuator.

4. The rotary switch according to claim 2, further comprising a roller attached to said plunger, said roller rolling along said conductor to connect or disconnect said at least two terminals when said actuator is pivoted.

5. The rotary switch according to claim 1, wherein said conductor is in slideable communication with said actuator.

6. The rotary switch according to claim 2, wherein said biasing member is a spring.

7. The rotary switch according to claim 4, further comprising at least one detent in said conductor adapted to fit said roller.

8. The rotary switch according to claim 1, further comprising a plurality of detents in said body located adjacent to said rotary knob and adapted to fit a nose of said rotary knob.

9. The rotary switch according to claim 8, further comprising a biasing member in said nose, said biasing member biasing said nose in an extended position inside one of said plurality of detents.

10. The rotary switch of claim 1, wherein said rotary knob pivots about a first axis, said actuator pivots about a second axis, said second axis being different than said first axis, and said conductor pivots about a third axis, said third axis being different than said first axis and said second axis.

11. The rotary switch of claim 10, wherein said second axis and said third axis are parallel.

12. The rotary switch of claim 11, wherein said first axis is orthogonal to said second axis and said third axis.

13. A switch comprising:

a body;

at least two terminals attached to said body;

an actuator pivotably mounted within said body;

a conductor pivotably mounted in said body and in communication with said actuator, said conductor adapted to connect or disconnect said at least two terminals when said actuator is pivotably moved wherein said body comprises a cam surface having at least one detent portion; and, wherein said knob comprises a projection which follows the cam surface and which is rotatable with the knob to follow the cam surface into and out of engagement with the at least one detent.

14. The switch according to claim 13, further comprising a plunger movably mounted to said actuator and a biasing member in operable communication with said actuator and said plunger, said biasing member biasing said plunger away from said actuator.

15. The switch according to claim 14, further comprising a roller attached to said plunger, said roller rolling along said conductor to connect or disconnect said at least two terminals when said actuator is pivoted.

16. The switch according to claim 13, wherein said conductor is in slideable communication with said actuator.

17. The switch according to claim 13, wherein said switch is a rotary switch, and wherein said rotary switch further comprises a rotary knob attached to said body and a cam located between said rotary knob and said actuator and eccentric to a rotational axis of said rotary knob, said cam translating a rotational movement of said rotary knob into a pivotable movement of said actuator.

18. The switch according to claim 13, wherein said switch is a rocker switch, and wherein said rotary switch further comprises a rocker attached to said body and said actuator, said rocker pivoting said actuator on actuation of said rocker.

19. The switch according to claim 14, wherein said biasing member is a spring.

20. The switch according to claim 15, further comprising at least one detent in said conductor adapted to fit said roller.

21. The switch according to claim 17, further comprising a plurality of detents in said body located adjacent to said rotary knob and adapted to fit a nose of said rotary knob.

22. The switch according to claim 21, further comprising a biasing member in said nose, said biasing member biasing said nose in an extended position inside one of said plurality of detents.

23. The switch of claim 13, wherein said rotary knob pivots about a first axis, said actuator pivots about a second axis, said second axis being different than said first axis, and said conductor pivots about a third axis, said third axis being different than said first axis and said second axis.

24. The switch of claim 23, wherein said second axis and said third axis are parallel.

25. The switch of claim 24, wherein said first axis is orthogonal to said second axis and said third axis.

26. A rotary switch comprising:

a body;

a rotary knob attached to said body;

at least two terminals attached to said body;

an actuator pivotably mounted within said body and operably connected to said rotary knob through a cam, said cam translating a rotational movement of said rotary knob into a pivotable movement of said actuator, and said cam being eccentric to a rotational axis of said rotary knob;

a plunger movably mounted to said actuator;

a spring in operable communication with said actuator and said plunger, said spring biasing said plunger away from said actuator;

a conductor pivotably mounted within said body and in rolling communication with said actuator through a roller, said conductor having at least one detent and said conductor adapted to connect or disconnect the at least two terminals when said actuator is pivotably moved;

wherein said roller is attached to said plunger and said roller rolls along said conductor to connect or disconnect said at least two terminals when said actuator is pivoted; and, wherein said cam comprises a post extending parallel to the rotational axis.

27. The rotary switch according to claim 26, further comprising a plurality of detents in said body located adjacent to said rotary knob and adapted to fit a nose of said rotary knob.

28. The rotary switch according to claim 27, further comprising a biasing member in said nose, said biasing member biasing said nose in an extended position inside one of said plurality of detents.

29. The rotary switch of claim 26, wherein said rotary knob pivots about a first axis, said actuator pivots about a second axis, said second axis being different than said first axis, and said conductor pivots about a third axis, said third axis being different than said first axis and said second axis.

30. The rotary switch of claim 29, wherein said second axis and said third axis are parallel.

31. The rotary switch of claim 30, wherein said first axis is orthogonal to said second axis and said third axis.

* * * * *